US009289801B2

(12) United States Patent
Maanum et al.

(10) Patent No.: US 9,289,801 B2
(45) Date of Patent: Mar. 22, 2016

(54) WASH-OUT CONTAINER

(75) Inventors: Thomas C. James Maanum, Maple Grove, MN (US); Thomas Johnson, Center City, MN (US); Anthony Palmer Hess, Marine On Saint Croix, MN (US)

(73) Assignee: T3 Enterprises, LLC, Marine on Saint Croix, MN (US)

( * ) Notice: Subject to any disclaimer, the term of this patent is extended or adjusted under 35 U.S.C. 154(b) by 840 days.

(21) Appl. No.: 13/191,912

(22) Filed: Jul. 27, 2011

(65) Prior Publication Data

US 2012/0024328 A1 Feb. 2, 2012

Related U.S. Application Data

(60) Provisional application No. 61/368,155, filed on Jul. 27, 2010.

(51) Int. Cl.

*B08B 3/00* (2006.01)
*B08B 3/02* (2006.01)
*B08B 17/00* (2006.01)

(52) U.S. Cl.

CPC ..... *B08B 3/006* (2013.01); *B08B 3/026* (2013.01); *B08B 17/00* (2013.01)

(58) Field of Classification Search

CPC ..... B08B 3/006; B08B 17/00; B08B 3/026
USPC ..... 134/104.2, 104.3, 104.4, 58 R, 89, 109, 134/110, 111, 184, 186
See application file for complete search history.

(56) References Cited

U.S. PATENT DOCUMENTS

| | | | | | |
|---|---|---|---|---|---|
| 3,960,728 | A * | 6/1976 | Otzen | 210/167.01 |
| 4,056,114 | A * | 11/1977 | Boutillette | 134/104.4 |
| 4,128,478 | A * | 12/1978 | Metzger | 210/167.01 |
| 4,143,669 | A * | 3/1979 | Minkin | 134/153 |
| 4,462,415 | A * | 7/1984 | Otzen | 134/111 |
| 5,107,876 | A * | 4/1992 | Ozyjiwsky | 134/111 |
| 5,232,299 | A * | 8/1993 | Hiss | 401/143 |
| 5,265,633 | A * | 11/1993 | Knowlton | 134/135 |
| 5,322,078 | A * | 6/1994 | Tuttle | 134/104.4 |
| 5,478,465 | A * | 12/1995 | Larson et al. | 210/167.31 |
| 5,485,860 | A * | 1/1996 | Robb et al. | 134/166 C |
| 5,499,643 | A * | 3/1996 | Vincent et al. | 134/104.4 |
| 5,702,607 | A * | 12/1997 | Lawson | 210/663 |
| 5,720,308 | A * | 2/1998 | Danowski et al. | 134/111 |
| 5,944,035 | A * | 8/1999 | Chen | 134/111 |
| 5,954,070 | A * | 9/1999 | Abad et al. | 134/89 |
| 6,044,852 | A * | 4/2000 | Epperson et al. | 134/56 R |
| 6,098,813 | A * | 8/2000 | Cini | 210/356 |
| 6,199,565 | B1 * | 3/2001 | Bluestone | 134/108 |
| 6,306,221 | B1 * | 10/2001 | Magliocca | 134/10 |
| 6,550,489 | B1 * | 4/2003 | Yates | 134/140 |
| 6,568,409 | B1 * | 5/2003 | Fleck | 134/110 |
| 6,609,258 | B1 * | 8/2003 | Clements | 4/655 |
| 7,980,257 | B2 * | 7/2011 | McClure et al. | 134/111 |
| 2006/0037635 | A1 * | 2/2006 | Rhodes | 134/200 |
| 2008/0314417 | A1 * | 12/2008 | Porter et al. | 134/34 |

* cited by examiner

*Primary Examiner* — Alexander Markoff
(74) *Attorney, Agent, or Firm* — Westman, Champlin & Koehler, P.A.; Theodore M. Magee

(57) ABSTRACT

A wash-out container has a collection basin, a filter and a pump. Water used for washing tools is filtered and re-used so the wash-out container is stand-alone.

20 Claims, 12 Drawing Sheets

WASH-OUT CONTAINER

CROSS-REFERENCE TO RELATED APPLICATION

The present application is based on and claims the benefit of U.S. provisional patent application Ser. No. 61/368,155, filed Jul. 27, 2010, the content of which is hereby incorporated by reference in its entirety.

FIELD

The present invention relates generally to an apparatus and process for cleaning. More specifically, the present invention pertains to a wash-out container and process for on-site cleaning of tools and utensils.

BACKGROUND

In the construction industry, many projects involve use of, and work with, concrete or other similar materials. At the end of a working shift, construction personnel often clean tools, used to handle concrete, with water. In some jurisdictions, the disposal of the water used to wash construction tools and equipment is regulated. For instance, the water, when used to wash out tools that were used in handling concrete, often contains dangerous or harmful materials such as chromium and other heavy metals. The pH value of the water is often very high, to the point where it must be handled in a controlled fashion.

Current solutions to this problem involve simply lining a large dumpster with a water-impermeable material, such as plastic. The tools to be washed out are then suspended over the dumpster and water is used to wash off the tools. The water and sedimentary material, after it washes out the tools, is captured in the dumpster. The water in the dumpster is occasionally emptied and disposed of in a controlled way, and periodically, the sedimentary material that accumulates in the dumpster is also disposed of. However, this type of system has several problems.

The dumpsters used are often very large and heavy. When they are deployed at a construction site, it is often very difficult to move them, even when they are empty. Therefore, as the construction site changes, it may be desirable to move the wash-out container (the dumpster), but that is very difficult because of the weight and cumbersome nature of the wash-out container.

In addition, the wash-out process that uses a conventional wash-out container requires external access to water. That is, there must be a constant source of clean water for use in performing the wash-out operation. This can be difficult to obtain or, where a mobile water supply is used, it can be expensive.

Similarly, personnel must constantly monitor the wash-out container to ensure that it is not getting full. If it is full, then wash-out operations must cease, until it can be emptied, because cleaning up a spill can be expensive and time consuming as well. In addition, if the wash-out container is relatively full, even a heavy rain can cause it to overflow.

SUMMARY

A wash-out container has a collection basin, a filter and a pump. Water used for washing tools is filtered and re-used so the wash-out container is stand-alone.

Figure 1A:
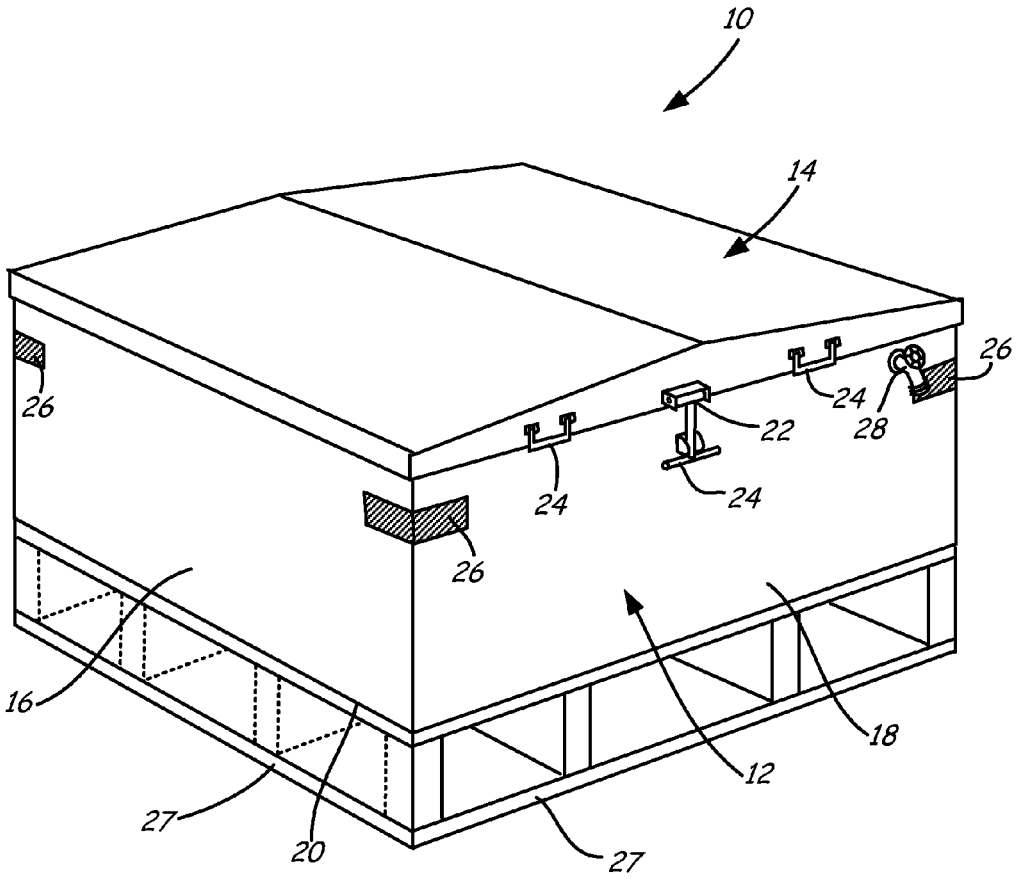
FIG. 1A is a perspective view of a wash-out container in accordance with an illustrative embodiment disposed on a fork lift pallet.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1A is a perspective view of a wash-out container 10 in accordance with an illustrative embodiment. In some embodiments, the container 10 comprises a self-contained unit that can be used for the on-site removal of concrete, sludge, or other debris from tools or utensils commonly used in concrete applications. The container 10 can be used for other cleaning processes and/or in other applications for removing sediment from objects. In the embodiment shown, the container 10 includes a base structure 12 and a lid 14. The base structure 12 includes a number of sides 16 and ends 18, which together define a catch basin that holds waste water, chemicals, and/or solvents collected during use. The base structure 12 may further include a number of compartments for storage and/or that provide access to a sump pump that can be used to re-use collected waste water or to pump collected waste water away from the container 10.

In some embodiments, the base structure 12 and lid 14 are formed from a recyclable material that is resistive to the presence of chemicals within the collected waste water. In certain embodiments, for example, the base structure 12 and lid 14 may comprise a moldable polymeric material such as high-density polyethylene (HDPE) that resists chemical degradation from collected waste water. Of course, other materials, such as aluminum or stainless steel, can be used as well. The base structure 12 and lid 14 can also be constructed from other light-weight materials, allowing the user to move an empty container 10 without the need for equipment.

FIG. 1A shows that bottom 20 of the base structure 12 may include fork-lift slots 27 or other features that facilitate transporting the container 10. In certain embodiments, for example, the bottom 20 of the base structure 12 can include three or four sets of slots 27 that permit a fork-lift to lift the container 10 from any side 16 or end 18 of the container 10. In some embodiments, the base structure 12 is configured to permit multiple wash-out containers 10 to be stacked vertically on top of each other for ease of storage and/or transport.

The lid 14 can be removably secured to the base structure 12 via a number of latches 22. The latches 22 may be hingedly coupled to the base structure 12 to permit a user to open and, in some cases, remove the lid 14 from the base structure 12, thereby exposing an interior portion of the container 10 for use. A number of handles 24 on the lid 14 facilitate removal of the lid 14 from the base structure 12. In some embodiments, the lid 14 is retractable relative to the base structure 12, allowing the lid 14 to remain with the base structure 12 at all times. In other embodiments, the lid 14 can be removed entirely from the base structure 12.

Figure 1B:
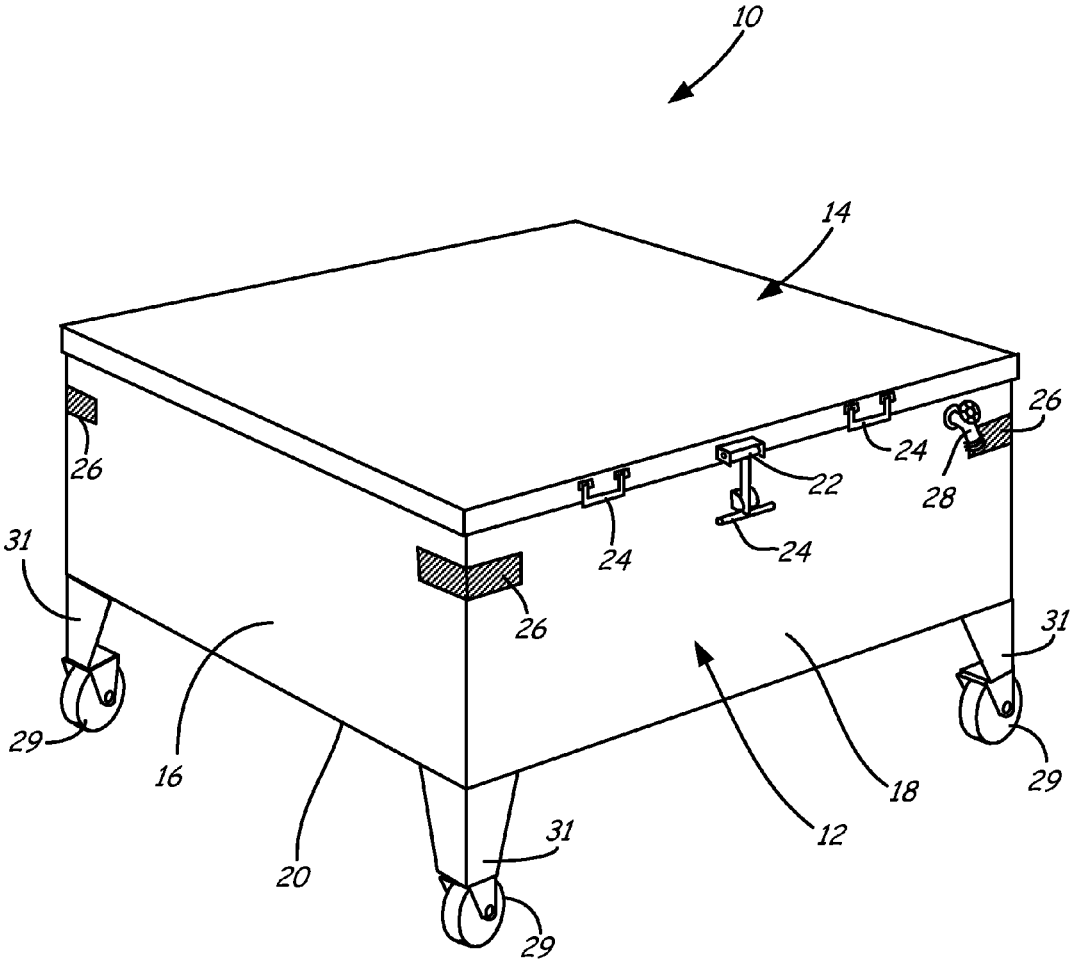
FIG. 1B is a perspective view of another embodiment of a wash-out container with wheels, and a relatively flat lid.

FIG. 1B shows another embodiment of container 10. Similar items to those shown in FIG. 1A are similarly numbered. FIG. 1B shows that the bottom 20 of container 10 has wheels or casters 29 disposed on legs 31. This allows container 10 to be easily moved.

Marking indicia such as reflective tape 26 can be placed on the sides 16, ends 18, and/or lid 14 to demarcate the periphery of the container 10. Portions of the container 10 may also have a particular color scheme or signage to provide the user with information about the container 10 such as its contents.

The size of the container 10, including the base structure 12 and lid 14, may vary depending on the particular application. For example, the size of the container 10 may vary depending on the amount of waste water to be collected, the location where the container 10 is to be used, as well as other factors. In some embodiments, the container 10 can be sized to fit on a fork-lift pallet with slots 27, a standard-size truck bed, or the like for storage and/or transport. In some embodiments, the container 10 is configured to support between about 10 gallons to about 100 gallons of waste water. Other container sizes are also contemplated, however.

Figure 2:
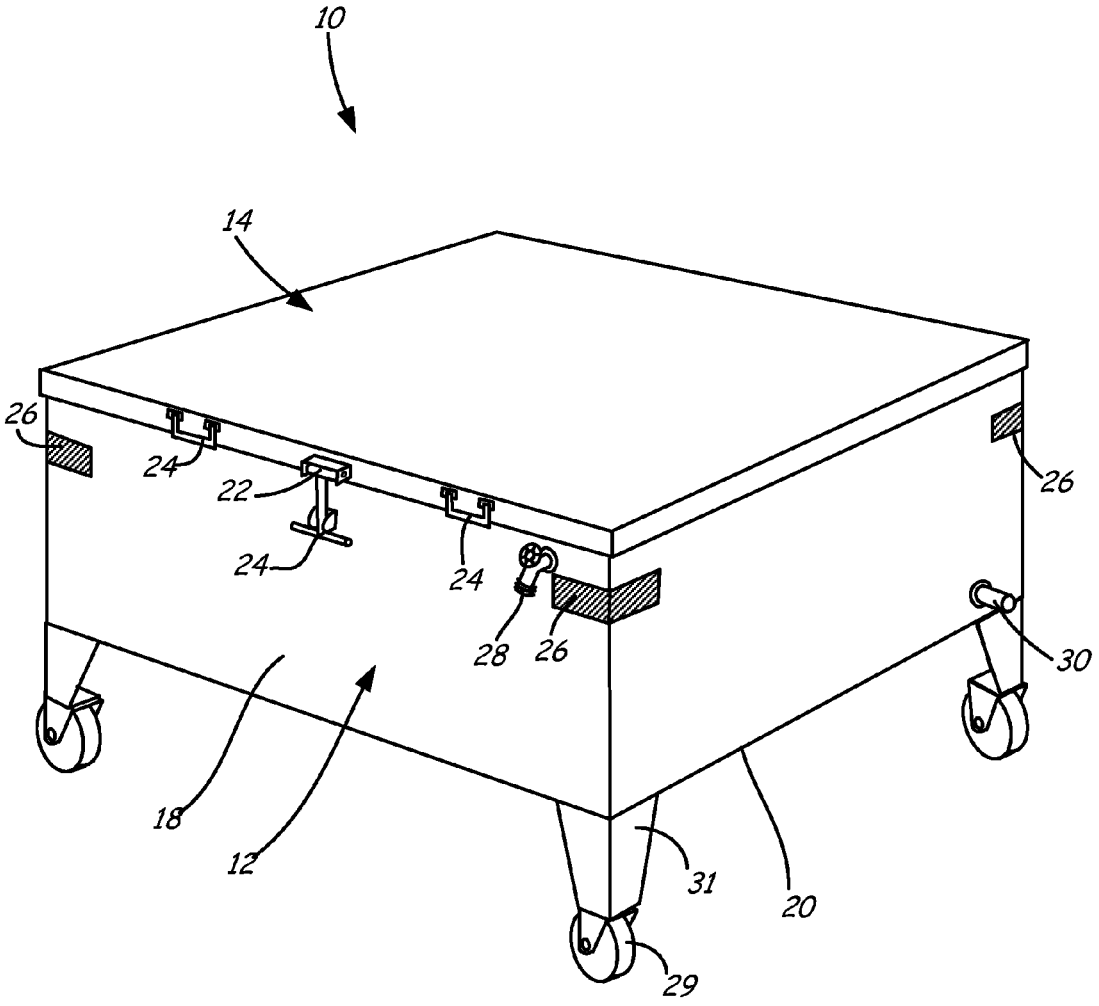
FIG. 2 is a perspective view of the wash-out container of FIG. 1B rotated approximately ninety degrees.

FIG. 2 shows a view of container 10 rotated ninety degrees from that shown in FIG. 1B. A water inlet 28 located on the exterior of the base structure 12 can be used for connecting a supply of pressurized fluid to the container 10. The inlet 28 may comprise, for example, a hose connection and valve that permits a user to connect a hose to a spray wand or other watering tool stored within a storage chamber in the container 10. A drain outlet 30 on the base structure 12, in turn, can be used for removing or recycling waste water collected by the container 10. In some embodiments, for example, the drain outlet 30 can be connected to a sump pump located within the container 10, allowing waste water to be pumped from the container 10 to another container. The drain outlet 30 may include a valve or seal 68 (see FIG. 6) to prevent waste water from exiting the container 10 until, and at such time, the user wishes to drain the container 10.

Figure 3:
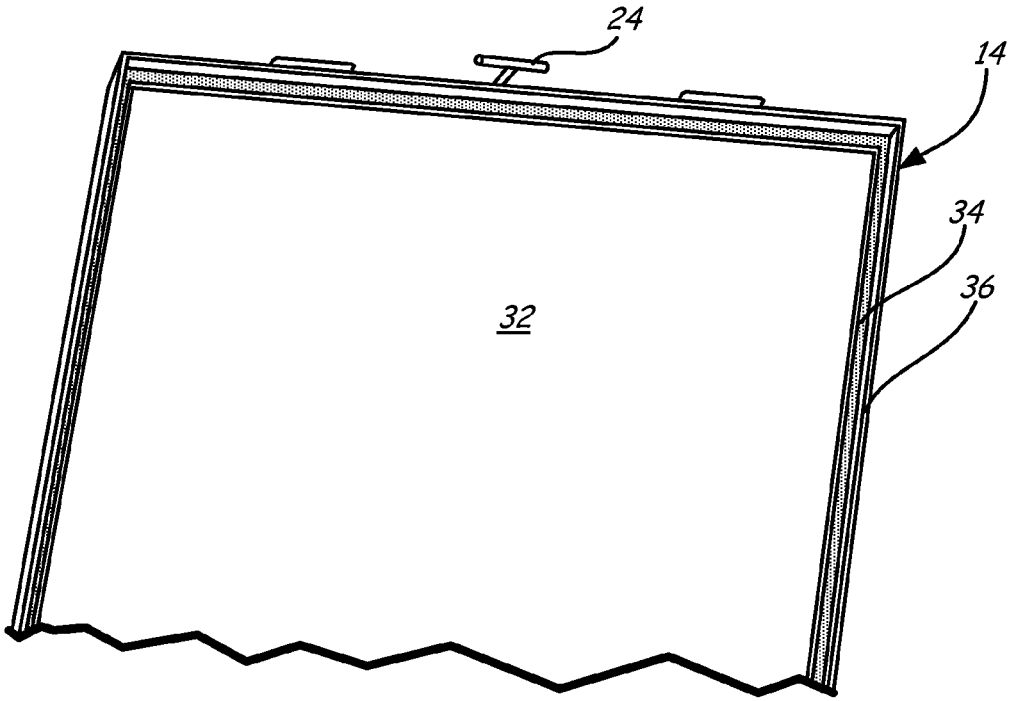
FIG. 3 is a perspective view showing a portion of the underside of the lid of the wash-out container.

FIG. 3 is a view showing a portion of the underside 32 of the lid 14 of FIG. 1. As shown in FIG. 3, the underside 32 can include a gasket 34, which serves to seal the lid 14 against the upper periphery of the base structure 12. In some embodiments, the gasket 34 comprises an elastomeric sealing ring that prevents contaminated liquid and/or fumes from escaping from the container 10, and to prevent rain, snow, or other matter from entering the container 10. As can be further seen in conjunction with FIG. 3, a lip 36 located between the gasket 34 and the bottom edge of the lid 14 forms an overlap when the lid 14 is attached to the upper periphery of the base structure 12.

Figure 4:
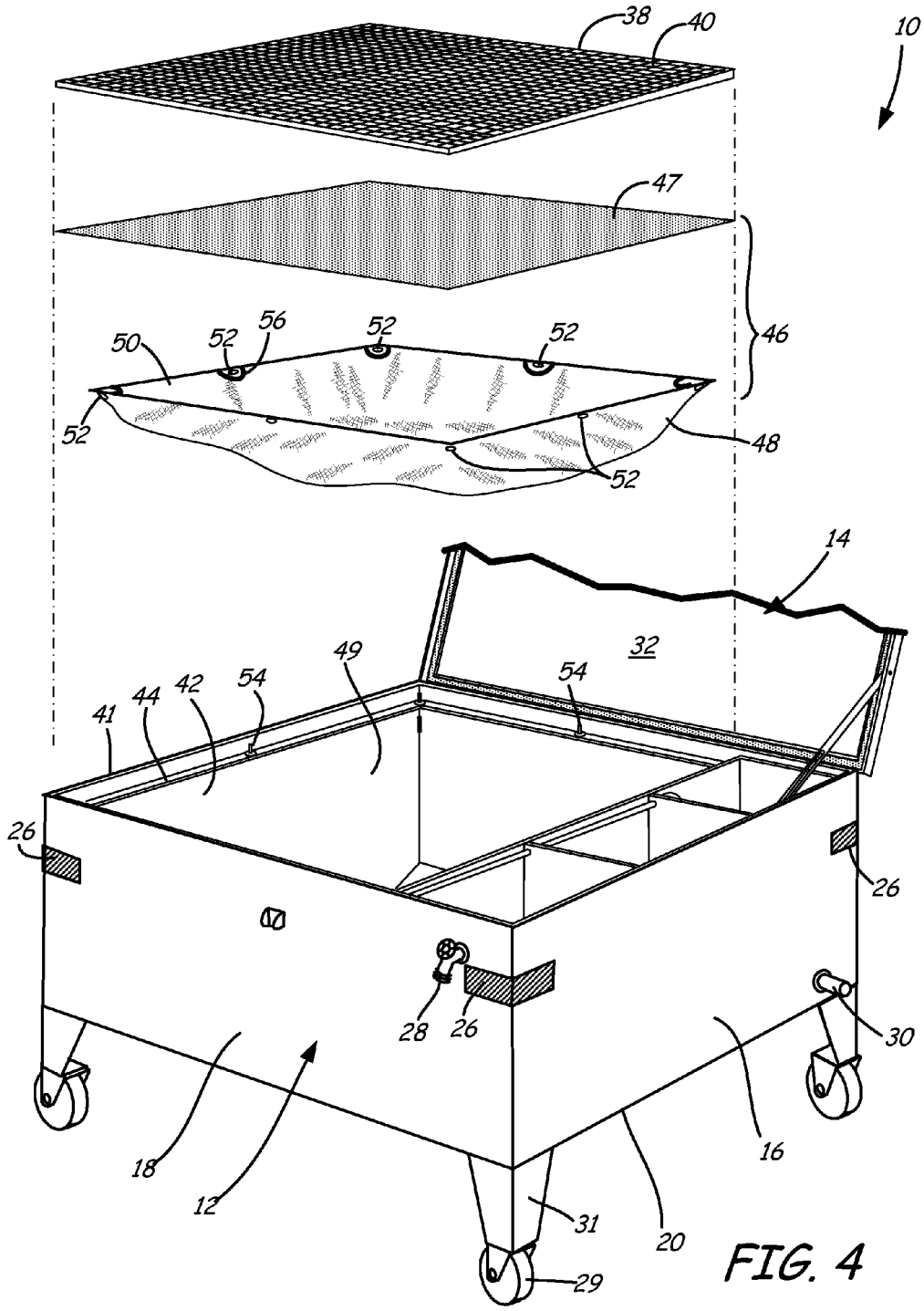
FIG. 4 is a perspective, exploded view showing an upper grate and filter used within the wash-out container.

FIG. 4 is an exploded view of the container 10 of FIG. 1B with the lid 14 rotated to an open position to show an upper grate 38 of the container 10 and a filter 46. The upper grate 38 can comprise a grating, screen, mesh, or other suitable means for supporting tools or utensils as they are cleaned while allowing waste water to flow through several openings 40 on the grate 38 through filter 46 and into a catch basin (or collection basin) 49 located further below within the base structure 12. In some embodiments, the upper grate 38 is configured to lie substantially flush against an upper periphery 42 of the base structure 12 via a flange 44 located on an inside portion of structure 12. In certain embodiments, the upper grate 38 may be inset a small distance below the upper lip 41 of the base structure 12, which serves to prevent the overflow of debris from the sides 16 and ends 18 of the base structure 12 during the wash-out process. If desired, a sign may be placed on the upper grate 38 warning the user not to stand or step on the grate 38.

The exploded view of FIG. 4 also shows that filter 46 includes a number of different components. For instance, in one embodiment, filter 46 includes pre-filter 47 and filter bag (or collection bag) 48. Pre-filter 47 acts to keep relatively fine sedimentary material on the top of filter bag 48. Water passes through pre-filter 47 and filter bag 48, but a large percentage of the sedimentary material is filtered out and remains on top of pre-filter 47. In one illustrative embodiment, pre-filter 47 is formed of three ounce spun landscape fabric, although other pre-filter materials could be used as well.

Figure 5:
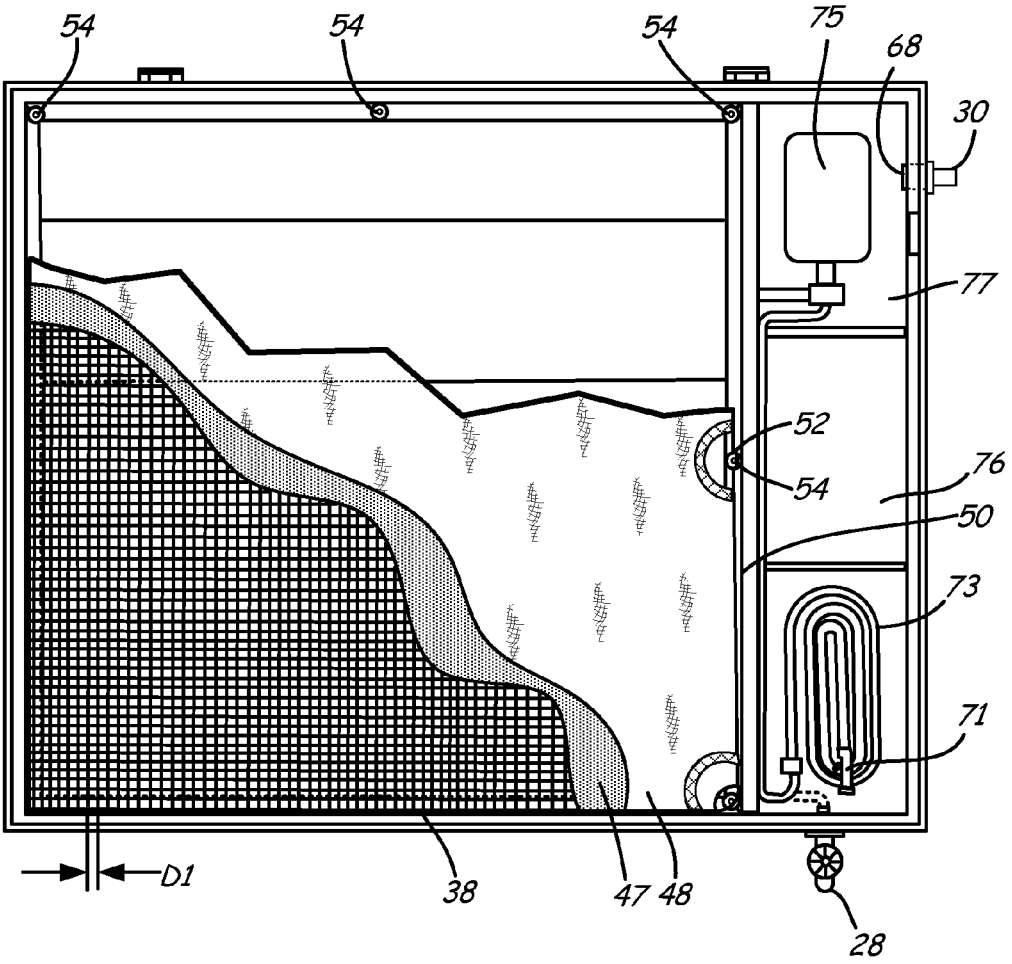
FIG. 5 is a top, cut away view showing the upper grate and filter in greater detail.

FIG. 5 is a top cut way view of container 10 with lid 14 removed and portions of the grate 38, pre-filter 47 and bag 48 cut away. As further shown in FIG. 5, the grate openings 40 can be sized such that the tools and/or utensils to be cleaned do not pass into the interior of the base structure 12. In some embodiments, the upper grate 38 may include square openings 40 having a dimension $D_1$ of between about 0.25 inches to about 1 inch, although other sizes and/or shapes are possible depending on the application.

The elements of FIG. 5 can also be seen in the exploded view of FIG. 4. These Figures show that, in some embodiments, the filter bag 48 comprises a porous collection bag 48 configured to permit waste water to pass through the bag 48 and into catch basin 49 within the base structure 12. The collection bag 48 can be formed from recyclable materials, and can be used either once or multiple times depending on the application. In some embodiments, the collection bag 48 includes reinforced stitching to help support the weight of hardened sediment collected during the wash-out process. The collection bag 48 may also be fabricated from a material or otherwise include a chemical (e.g., citric acid) that aids in reducing the alkalinity of the wash-out debris.

Of course, bag 48 can be formed of a wide variety of different materials. In one embodiment, it is a relatively strong and tear resistant, mesh material that does not puncture easily. As one example, bag 48 is formed of 8 oz woven polypropylene material. Such a material is sold under the registered trademark PERMATRON, by Tencate of Pendergrass, Ga. However, other materials, and different weight materials can be used as well.

Figure 6:
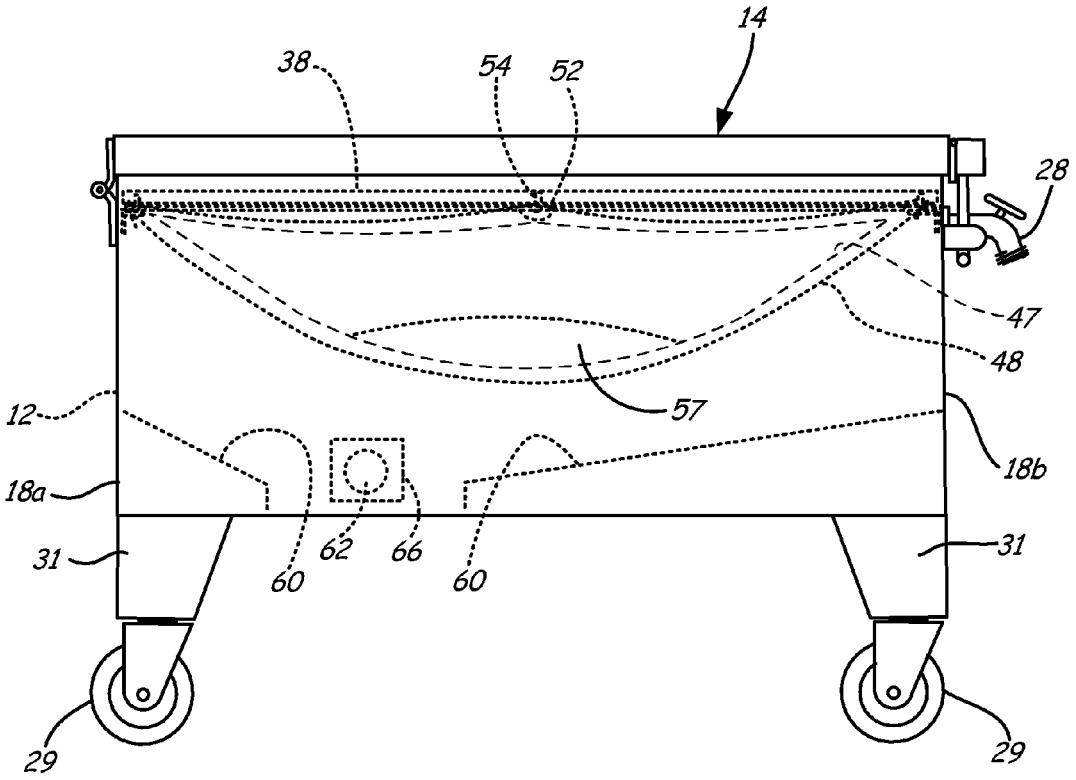
FIG. 6 is a side view showing a grate and filter in phantom.
Figure 7:
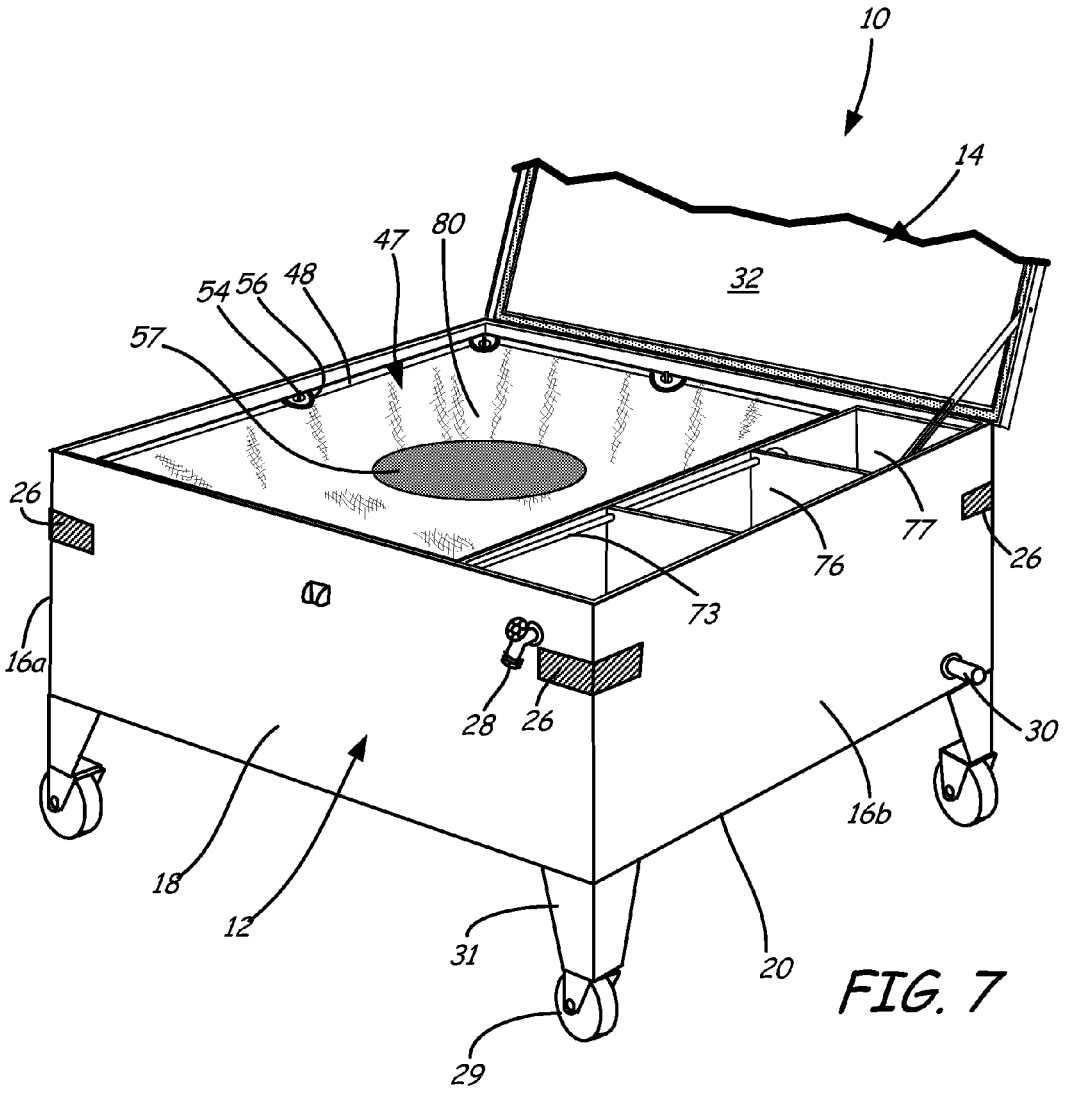
FIG. 7 is another view of the wash-out container showing the upper grate removed from the base structure; and showing the attachment of the collection bag and pre-filter to an upper periphery of the base structure.

FIG. 6 is a side view of container 10 with some of the elements shown in phantom. FIG. 7 is a perspective view of container 10 with sediment 57 located on filter 46. FIGS. 4-7 will now be discussed in conjunction with one another.

Figure 8:
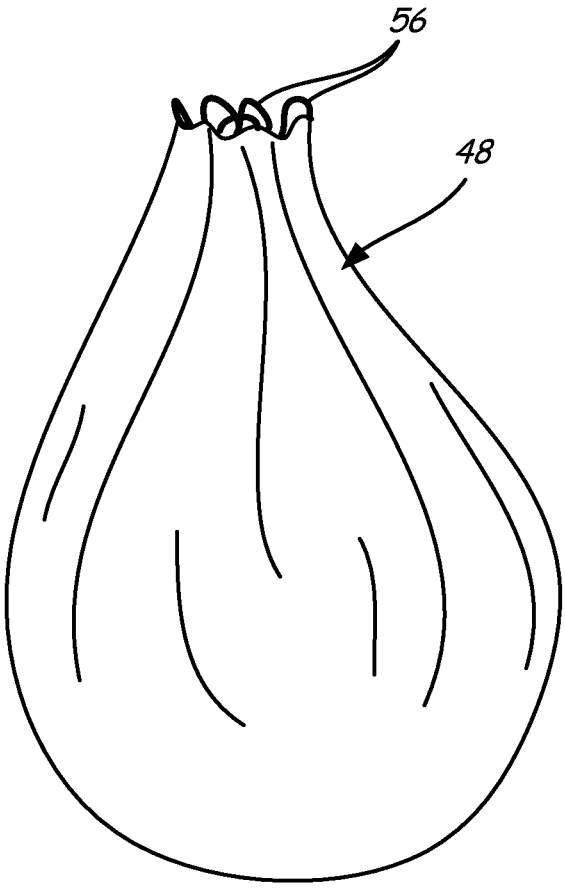
FIG. 8 is a view showing the collection bag removed from the container.

In preparation for use, the collection bag 48 can be stretched open and releasably coupled about its upper edge 50 to the upper periphery 42 of the basin 49 in base structure 12. In some embodiments, the upper edge 50 of the collection bag 48 can be secured to the flange 44 of the base structure 12 via a number of eyelets 52. Each of the eyelets 52 are configured to fit about a corresponding peg 54 extending upwardly from the flange 44. In some embodiments, the pegs 54 may also be used to releasably secure the upper grate 38 to the base structure 12. During cleaning, tools are set on grate 38. Nozzle or spray wand 71 is connected by a hose 73 to a sump pump 75 disposed in chamber 77. Water is pumped by pump 75 through hose 73 to wand 71 where it is used to spray off the tools on grate 38. The water passes through grate 38 and filter 46 into basin 49 and sediment 57 is filtered from the water by grate 38 and filter 46 (pre-filter 47 and bag 48). After the cleaning process, the upper edge 50 of the collection bag 48 can be removed from the flange 44 and drawn together, allowing the user to remove the bag 48 and the collected sediment via a number of bag handles 56. FIG. 8 shows filter 46 (pre-filter 47 and bag 48) folded together to contain the sediment.

As can be further seen in FIG. 6, a lower section of the base structure 12 located below the flange 44 forms a catch basin 49 configured to receive wash-water that has been separated from sediment collected by the filter 46. In some embodiments, and as further shown in FIGS. 6 and 7, the bottom surface 60 of the catch basin 49 can be sloped from one side 16*a* of the base structure 12 to the other side 16*b*, In addition, or in lieu, the bottom surface 60 can also be sloped from each end 18 of the base structure toward an inlet 62.

In use, the sloped surface 60 redirects contaminated water towards inlet 62 in fluid communication with sump-pump compartment (or chamber) 77 disposed within the container 10. As can be further seen in FIG. 6, the inlet 62 can include a fine-mesh grate 66, a tubular-shaped inlet, or other suitable means for filtering out any sediment. During use, the grate 66 serves as a secondary filter to further remove any sediment not removed by the filter 46 and grate 38. Also, inlet 62 is illustratively located slightly above the floor of container 10 to let any remaining sediment settle to the floor and to inhibit its introduction into the pump chamber 77.

FIG. 5 shows sump-pump compartment 77 located within the container 10. The sump-pump compartment 77 includes a drain pipe 30 which, as further discussed above with respect to FIG. 2, can be used to drain and/or pump waste water from the container 10. A valve or seal 68 coupled to the drain pipe 30 can be used to prevent waste water from exiting the container 10. In some embodiments, sump pump 75 is gas powered, electrically powered, or powered in another way and located within the compartment 77 and can be used to pump waste water received from the inlet 62 through the drain pipe 30 and out of the container 10. In another embodiment, the sump pump 75 can be used to pump the waste water to spray nozzle or wand 71 to re-cycle the water for use in washing tools. In that embodiment, container 10 is filled with a desired amount of water (such as 25-100 gallons or another amount) and the sump pump 75 pumps the water through the nozzle or wand 71 for use in cleaning or performing the wash out process. In that embodiment, container 10 is a stand-alone container that does not need access to an external water source.

FIG. 5 shows the connection of the water inlet 28 to a spray wand 71 (in phantom) located within a storage compartment 72. This illustrates that wand 71 can be hooked to pump 75 or to inlet 28 to receive water from an external source. In that embodiment, the water inlet 28 is connected to an external water source. The water inlet 28 can be connected to the spray wand 71 via extension hose 73 having a length sufficient to allow the user to clean any tools or utensils from a position above the upper grate 38. In some embodiments, and as further shown, the container 10 may include one or more other storage compartments 76 for storing additional collection bags 48, pre-filters 47, as well as other tools used during the wash-out process.

An example process for cleaning sediment from tools, utensils, or other objects using the wash-out container 10 will now be described in more detail. Prior to cleaning, the user opens or removes the lid 14, and secures a clean collection bag 48 and pre-filter 47 onto the flange 44 of the base structure 12 by inserting the eyelets 52 over the connection posts (or pegs) 54 and laying out pre-filter 47 on top of bag 48. Once bag 28 is secured to the base structure 12, the user then secures the upper grate 38 in position over collection bag 48 and pre-filter 47 on flange 44.

Once the filter 46 (bag 48 and pre-filter 47) and upper grate 38 are secured in position, the user may then place the objects to be cleaned onto the upper grate 38. The user may then clean the objects using spray wand 71 or other suitable watering tool (whether supplied with water from an external source or with recycled water using the sump pump 75). As the objects are cleaned, the sediment 57 (which is smaller than the openings in grate 38) passes through the grate openings 40 and is collected on the upper, exposed surface 80 of the pre-filter 47 and collection bag 48 where it is separated from the wash-water.

FIG. 7 shows the presence of hardened sediment 57 collected on the upper, exposed surface 80 of a pre-filter 47 and collection bag 48. As shown in FIG. 7, the weight of the hardened sediment 57 on the filter 46 causes the sediment 57 to collect towards the middle portion of the filter 46. The contaminated wash-water, in turn, is collected within the catch basin 49 and drains into pump chamber 78 for re-use (with sump pump 75) or for later removal and/or processing. In some embodiments, for example, the contaminated wash-water can be pumped from the container 10 into a second container or can be reused for other applications, as desired.

Once the sediment has been collected, the pre-filter 47 and collection bag 48 can be removed from the base structure 12 by pulling on the handles 56 while also drawing the upper edge 50 of the collection bag 48 together to a position such as that shown, for example, in FIG. 8. The sediment 57 can then be removed from the collection bag 48 by removing pre-filter 47. One or both of bag 48 and pre-filter 47 can be discarded or washed for re-use.

Figure 9:
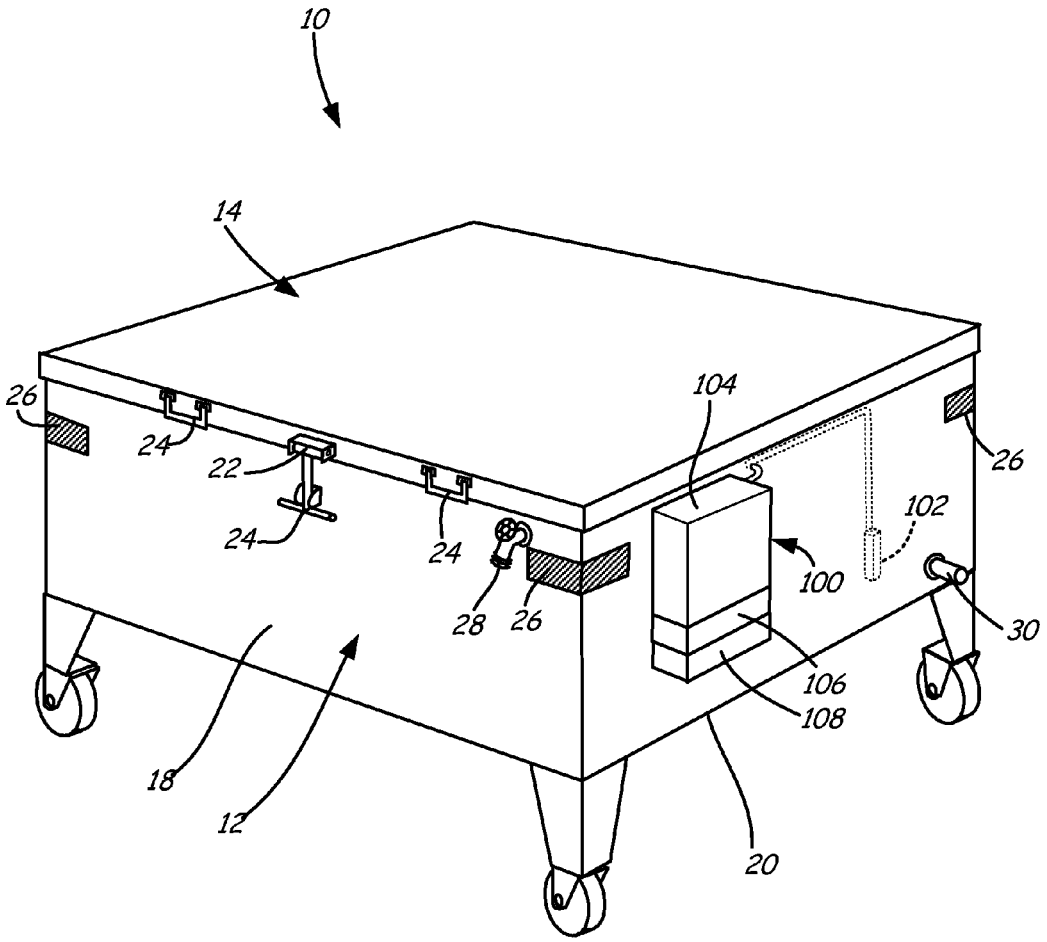
FIG. 9 is another view of the wash-out container with a pH monitor and dispenser.

In one embodiment, a pH monitor and dispenser 100 is provided. This is shown in partial block diagram and partial schematic form, in FIG. 9. FIG. 9 shows that pH monitor and dispenser 100 includes a pH monitor probe 102, a pH monitor 104, a pump 106 and a chemical source 108. Probe 102 is disposed in the sump chamber 77 of wash-out container 10 such that it is submerged in the water, and senses a characteristic indicative of the pH level of the water in the sump chamber 77. The probe 102 is also connected to monitor 104, either by a wired connection or a wireless connection and transmits a signal indicative of the sensed characteristic to monitor 104. Monitor 104, in turn, measures the pH value of the water based on the signal received from probe 102 and controls pump 106 to add chemical 108 in order to keep the pH value of the water within a desired range. For instance, when wash-out container 10 is used in concrete applications, the pH value of the water used to wash the tools is illustratively highly basic. Therefore, chemical source 108 is illustratively a source of acid, such as muriatic acid, which is added to the wash-out water by pump 106. pH monitor 104 illustratively controls pump 106 to add acid from source 108 so that the pH level of the water stays within a given, predetermined range of pH values. If the pH value is sufficiently neutral, then the water can simply be discharged onto the ground when desired. Alternatively, it can continue to be reused by having the sump pump 75 continue to pump the water through nozzle or wand 71 for wash-out operations.

Figure 10:
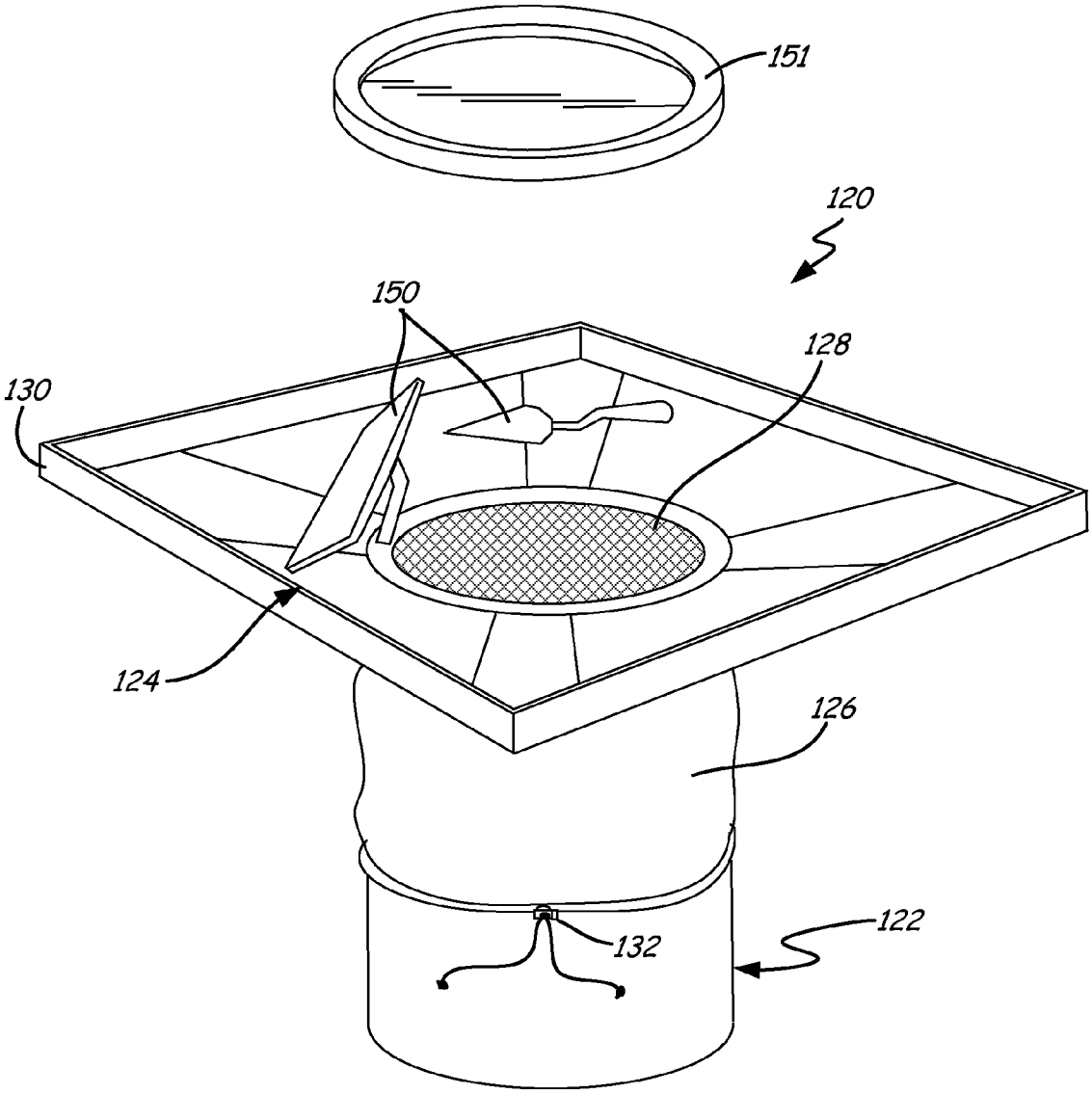
FIG. 10 is a perspective view showing another embodiment of a wash-out container.
Figure 11:
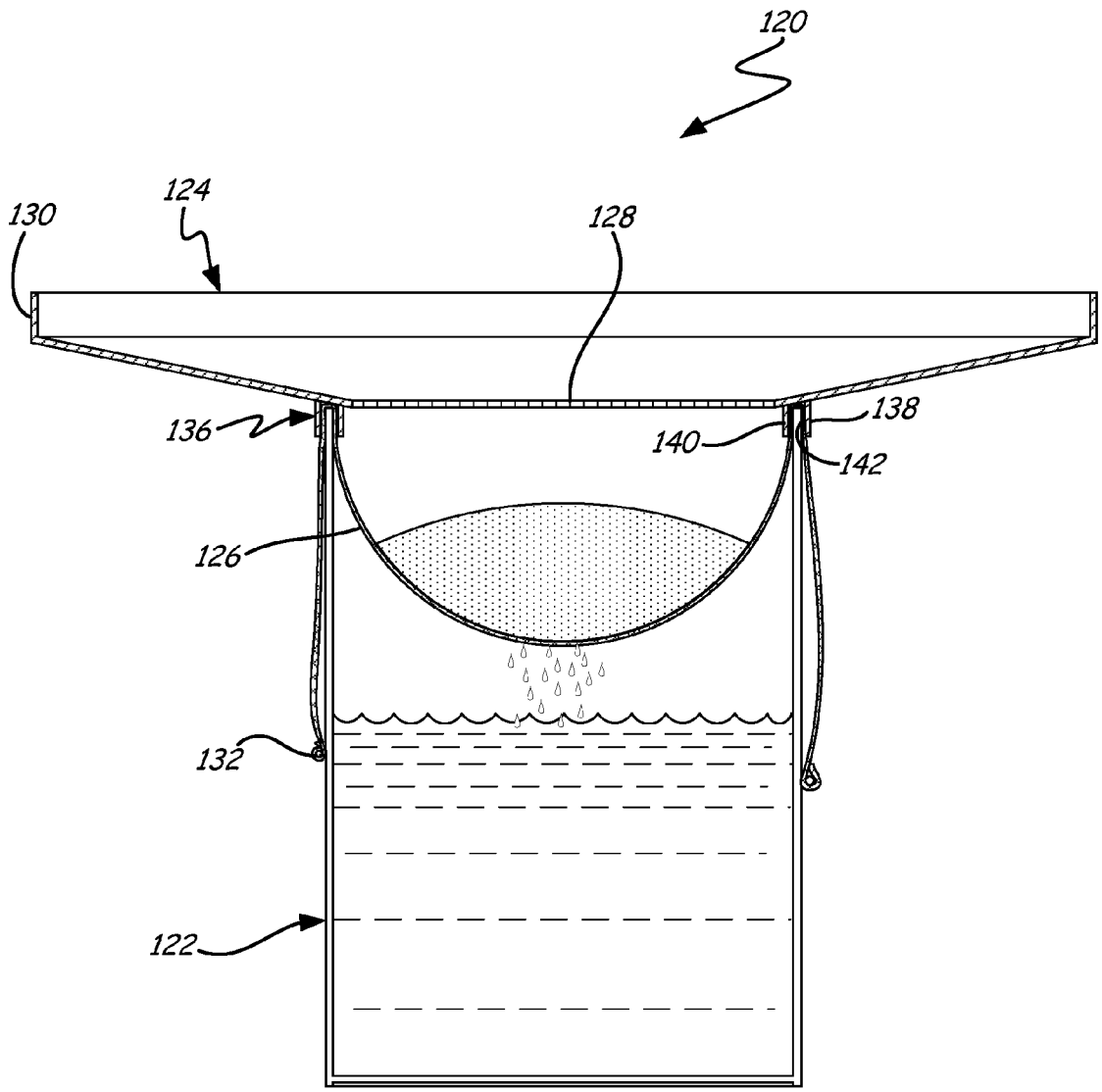
FIG. 11 is a side sectional view of the container of FIG. 10.

FIGS. 10-11 illustrate another embodiment of a wash-out container for smaller projects, such as consumer projects. FIGS. 10 and 11 are a perspective view and a side sectional view, respectively, of wash-out container 120. Wash-out container 120 includes a containment vessel 122, tray 124, and filter 126. Tray 124 is shown with a grate 128 disposed therein. As seen in FIGS. 10 and 11, tray 124 has an outer periphery with a lip 130. Tray 124 is also, illustratively, gently sloped towards a center hole that contains grate 128.

Filter 126 is illustratively a fabric material such as landscaping fabric or other material which, (before tray 124 is placed on vessel 122), is placed over the upper opening of vessel 122 such that it extends downwardly within vessel 122, as shown in FIG. 11. Filter 126 illustratively includes a fastening mechanism 132 at one end thereof. In the embodiment shown in FIG. 10, fastening mechanism 132 is a draw string, but other fastening mechanisms could be used as well. Therefore, the user first places filter 126 within vessel 122, with the upper end of filter 126 extending outwardly and around the outer periphery of the opening of vessel 122. The draw string is then drawn tightly around the outer periphery of vessel 122 to secure filter 126 to vessel 122. Then, tray 124 is placed on vessel 122 to cover the upper opening of vessel 122 and to further secure filter 126 to vessel 122.

FIG. 11 shows that tray 124 has an extending flange 136 that extends away from an outer periphery of grate 128. Flange 136 has an outer wall 138 and an inner wall 140 that define and annular channel 142. Annular channel 142 is illustratively sized to fit over a rim that defines the upper opening of vessel 122. Therefore, after filter 126 is placed on vessel 122 and the draw string is tightly secured thereto, tray 124 is placed over the opening of vessel 122 such that the upper rim of vessel 122, that defines the upper opening thereof, slides into, and snuggly fits within annular channel 142 of tray 124. This helps to hold filter 126 in place during use.

FIG. 10 shows that a variety of different tools 150 can be placed on the upper surface of tray 124. Water is then used to wash the tools 150, and the water and sediment flow downwardly into the central opening in tray 124. Grate 128 holds large sedimentary material on the top of grate 128, so that material can be easily disposed of. More fine material is carried by the water and passes through grate 128, but is caught by filter 126. The water used to wash tools 150 passes through filter 126 and into vessel 122.

In one embodiment, vessel 122 is simply a 5 gallon bucket. After the wash-out operation is performed, tray 124 is removed from the upper opening of vessel 122, and filter 126 is removed by loosening fastening mechanism 132 and lifting the outer periphery of filter 126 in the upward direction, and then closing or tightening fastening mechanism 132. This acts to hold the sedimentary material trapped by filter 126 within filter 126, so filter 126 can be removed and disposed of. A lid 151 is then placed on vessel 122 so the waste water can be disposed of or stored for later disposal.

Although the present invention has been described with reference to preferred embodiments, workers skilled in the art will recognize that changes may be made in form and detail without departing from the spirit and scope of the invention.

What is claimed is:

1. A wash-out container, comprising:

a base structure that defines a collection basin and a pump chamber located on a side of the collection basin, the base structure having a periphery, an opening of the collection basin and an opening of the pump chamber, wherein the periphery defines outer walls of the collection basin and the pump chamber, a support flange provided on walls of the opening of the collection basin, proximate to and recessed from the opening of the collection basin, and the collection basin has an inlet that drains liquid from the collection basin to the pump chamber;

a pump connected by a hose to a discharge member, the pump located in the pump chamber to pump liquid from the pump chamber, through the hose, to the discharge member for user-controlled discharge through the discharge member;

a grate fitting within the opening of the collection basin and removably supported by the support flange of the collection basin, the grate extending over substantially the entire opening of the collection basin; and a filter removably connected within the base structure between the grate and the support flange and extending over substantially the entire opening of the collection basin, the filter being formed to filter sedimentary material from liquid passing through the grate into the collection basin and being formed of foldable material to fold the sedimentary material therein for disposal.

2. The wash-out container of claim 1 wherein the filter has filter connection members disposed about an outer periphery thereof and wherein the support flange has base connection members disposed therein that cooperate with the filter connection members to releasable secure the filter to the support flange.

3. The wash-out container of claim 2 wherein the filter connection members comprise eyelets and wherein the base connection members comprise tabs, the eyelets being sized to receive the tabs therein.

4. The wash-out container of claim 1 wherein the filter comprises:

a pre-filter sheet; and a filter bag, the pre-filter sheet being disposed on the filter bag between the grate and the filter bag.

5. The wash-out container of claim 4 wherein the pre-filter comprises three ounce spun landscaping fabric covering substantially the entire filter bag.

6. The wash-out container of claim 4 wherein the filter bag comprises a porous material allowing liquid that passes through the pre-filter to pass there through into the collection basin, but filters sedimentary material from the liquid.

7. The wash-out container of claim 4 and further comprising:

an inlet fixture sized to receive connection to a water source external to the wash-out container.

8. The wash-out container of claim 4 and further comprising:

an outlet fixture disposed in the pump chamber to drain liquid from the pump chamber out of the base structure.

9. The wash-out container of claim 1 wherein the collection basin has a floor that is sloped toward the inlet that drains the liquid from the collection basin to the pump chamber.

10. The wash-out container of claim 9 wherein the inlet is spaced from the floor to permit sedimentary material to settle to the floor below the inlet to inhibit sedimentary material from entering the pump chamber.

11. The wash-out container of claim 1 wherein the grate is rigid relative to the filter.

12. The wash-out container of claim 1 and further comprising:

a lid removably attached to the base structure to cover the opening.

13. The wash-out container of claim 12 wherein the lid has a gasket disposed therein to assist in sealing the opening to inhibit liquid from passing there through.

14. The wash-out container of claim 1 wherein the base structure further comprises wheels connected thereto.

15. The wash-out container of claim 1 wherein the base structure further defines pallet fork slots.

16. The wash-out container of claim 1 and further comprising:

a pH monitor with a probe disposed in the pump chamber to measure a pH level of the liquid in the pump chamber.

17. The wash-out container of claim 16 wherein the pH monitor further comprises:

a pump coupled to the pH monitor and a chemical source and controllably adding chemical from the chemical source to the liquid in the pump chamber based on the measured pH level of the liquid.

18. The wash-out container of claim 17 wherein the pH monitor controls the pump to add the chemical to the liquid to keep the pH level of the liquid in a predetermined range of pH levels.

19. A wash-out container for washing concrete from tools, comprising:

a base forming a collection basin with an opening at an upper end of the base, the base having a flange disposed on walls of the collection basin proximate to, and recessed from, the opening, the base further forming a pump chamber on a side of the collection basin, the pump chamber having an opening at the upper end of the base and the pump chamber receiving liquid from the collection basin through an inlet opening, the collection basin having a floor sloped toward the inlet opening, and the inlet opening being spaced above the floor to inhibit sediment in the liquid from passing to the pump chamber;

a grate supported by the flange and having openings that filter material from liquid passing through the grate;

a filter, hung within the collection basin on the flange and positioned between the grate and the floor, the filter being formed of relatively flexible material, relative to the grate, so that material that passes with the liquid through the grate is filtered from the liquid by the filter, the filter being foldable and removable so the filtered material is folded within the filter for removal with the filter; and a pump disposed within the pump chamber and connected by a conduit to a spray mechanism, the pump pumping the liquid that enters the pump chamber from the collection basin to the spray mechanism for controllable discharge therethrough.

20. The wash-out container of claim 19 and further comprising:

a pH monitor and dispenser having a probe sensing a pH level of the liquid in the pump chamber and a dispenser dispensing a chemical into the liquid in the pump chamber, based on the sensed pH level, to control a pH level of the liquid in the pump chamber.

* * * * *